United States Patent [19]

Snyder et al.

[11] Patent Number: 4,875,575

[45] Date of Patent: Oct. 24, 1989

[54] POUCHED LAUNDRY WASH ACTIVE DISPENSER FOR IMPROVED SOLUBILITY

[75] Inventors: Stephen W. Snyder; Craig C. Monsell; Carol S. Puckett, all of Cincinnati, Ohio

[73] Assignee: The Procter & Gamble Company, Cincinnati, Ohio

[21] Appl. No.: 237,243

[22] Filed: Aug. 26, 1988

Related U.S. Application Data

[63] Continuation-in-part of Ser. No. 148,451, Jan. 26, 1988, abandoned.

[51] Int. Cl.[4] ..... D06F 39/02

[52] U.S. Cl. ..... 206/0.5; 68/17 A

[58] Field of Search ..... 206/0.5; 68/17 R, 17 A

[56] References Cited

U.S. PATENT DOCUMENTS

| | | | |
|---|---|---|---|
| 3,048,993 | 8/1962 | Lucas et al. | 68/17 |
| 3,344,626 | 10/1967 | Spangler | 68/17 R |
| 3,575,021 | 4/1971 | Bochan | 68/17 |
| 3,670,530 | 6/1972 | Filipak | 68/17 A |
| 4,026,131 | 5/1977 | Dugger et al. | 68/17 A |
| 4,260,054 | 4/1981 | Bory et al. | 68/17 A |
| 4,410,441 | 10/1983 | Davies et al. | 206/0.5 |
| 4,638,907 | 1/1987 | Bendenk et al. | 206/0.5 |
| 4,776,455 | 10/1988 | Anderson et al. | 206/0.5 |

FOREIGN PATENT DOCUMENTS

| | | | |
|---|---|---|---|
| 1298454 | 12/1972 | United Kingdom | 68/17 R |

*Primary Examiner*—William Price

*Attorney, Agent, or Firm*—Leonard Williamson; Robert B. Aylor; Richard C. Witte

[57] ABSTRACT

This invention relates to a disposable dispenser which is designed to be removably fastened to the central agitating post of a washing machine for dispensing a laundry active into the wash water of the machine.

6 Claims, 3 Drawing Sheets

POUCHED LAUNDRY WASH ACTIVE DISPENSER FOR IMPROVED SOLUBILITY

CROSS-REFERENCE TO RELATED APPLICATION

This is a continuation-in-part of our copending application, U.S. Ser. No. 148,451, filed Jan. 26, 1988, now abandoned for POUCHED LAUNDRY WASH ACTIVE DISPENSER FOR IMPROVED SOLUBILITY.

TECHNICAL FIELD

This invention relates to a pouched laundry wash water active dispenser.

BACKGROUND OF THE INVENTION

There are several pouched laundry active dispensing devices available commercially which are added to the laundry for the wash/or rinse period(s) of an automatic clothes washing machine.

U.S. Pat. No. 4,026,131, Dugger et al., issued May 31, 1977, incorporated herein by reference, discloses an apparatus for dispensing a laundry additive into an automatic washing machine at the rinse cycle. This reference does not address the problem of dispensing a detergent in the wash cycle.

The problems associated with some reusable "free-body" type dispensers are that they are messy to fill, i.e., the particular laundry additive has to be manually handled. Some are cumbersome to use, and subject to clogging. Some are limited only to the use of a laundry additive in liquid form.

Another type of dispenser is one that is built into the washing machine itself as part of the central agitating post wherein the top of the post is in the form of a cup to which a liquid laundry additive can be added. The centrifugal force obtained by the spin of the agitating post during the rinse cycle or spin cycle causes the liquid additive to emerge whereby the rinse water is enabled to flush out the additive into the laundry. Not only is this type of apparatus cumbersome, but it also causes exposure of the additives to the human hands, and tends to leave a residue in the aforementioned cup due to the lack of efficient flushing of the additive into the laundry. Moreover, this type of apparatus is not designed for wash water actives and prohibits the use of solids, which would not flow as evenly as a liquid.

Another type of a built-in dispenser system utilizes a solenoid valve and a gravity feed. Again, it is difficult to dispense solids and any liquid material which has a tendency to gel, since it tends to clog the valve or the tubing used. More importantly, however, all of the foregoing dispensers require frequent refilling (as often as every wash), which can be untidy and inconvenient, and requires intimate handling of materials which may be irritating to the skin, eyes, mucous membranes, and other parts of the body.

A popular dispenser for introducing laundry actives into the wash water in automatic washers is a free-bodied pouch dispenser, e.g., the ones disclosed in U.S. Pat. No. 4,348,293, Clarke et al., issued Sept. 7, 1982, and commonly assigned U.S. Pat. No. 4,740,326 Hortel et al., issued Apr. 26, 1988, both incorporated herein by reference. Dissolution of a paste or granular detergent for such dispensers can be a problem, particularly in heavily loaded washes when the pouch is trapped in the load. Accordingly, a need has arisen to provide a device that will dispense the detergent in an effective and simple manner for complete dissolution in extra large loads.

SOME OBJECTS OF THE PRESENT INVENTION

It is therefore an object of the present invention to provide a laundry active dispensing device that is disposable in nature and which will dispense the laundry active in a simple and efficient manner during the wash period of an automatic clothes washing machine.

Another object of the present invention is to provide a laundry active dispenser that is designed to be fastened to the central post agitator for improved dissolution of the laundry active in the wash period.

A further object of the invention is to provide a disposable dispenser that has the laundry active premeasured and sealed therein, thereby minimizing any need for the handling of the active which may be irritating to the skin, eyes, mucous membranes, or other parts of the body.

Still another object of the invention is to provide a laundry active dispenser that can be easily retrieved and disposed of at the end of either the entire laundry washing or drying programs.

It has now been discovered that the above and other objects of the present invention are accomplished by the provision of a disposable, single-use dispenser made of inexpensive materials that will effectively add a laundry active during the wash period of an automatic washer having an upright central agitating post. Thus, the present invention is applicable for use in those machines that have a central agitating post for the automatic deterging of wash loads.

SUMMARY OF THE INVENTION

This invention relates to a pouched disposable dispenser which is designed to be removably attached to the central agitating post of a washing machine for dispensing a laundry active, e.g., a detergent or bleach, into the wash water of the machine. Also disclosed is a method of dispensing a pouched laundry active into the wash water of a washing machine.

DETAILED DESCRIPTION OF THE INVENTION

Before describing the operation of the laundry active dispenser in accordance with the invention herein, a brief description of the steps involved in operating a standard automatic clothes washing machine having an upright central agitator post will facilitate an understanding and appreciation of the dispenser. The following basic steps are involved.

1. Filling machine with water for wash.
2. Agitating the wash load for 2 to 15 minutes by the reciprocating rotational movement of a central finned agitating post (Wash Period).
3. Draining the wash water by gravity and/or pump.
4. Spinning operation to remove most of the residual wash water which involves the continuous rotation of the central agitating post together with the inner clothes tub, thereby creating "centrifugal force" to drive off the water (Spin Period).
5. Filling the automatic washer with water for rinse.
6. Agitating the wash load for 2 to 10 minutes by the movement described in Step 2 (Rinse Period).
7. Spinning the central agitating post, together with the inner clothes tub, to remove most of the residual rinse water from the laundry.

Any one of, or combination of, soaks, prewashes and laundry actives and/or additives can be added to the machine operation. The dispenser according to the invention herein is used to dispense a laundry active into the machine operation during Step 2, that is, during the Wash Period.

According to the invention herein, a disposable dispenser is provided for the dispensing of a laundry active during the wash period of an automatic clothes washing machine having an upright central agitating post. The invention comprises a sealed water-permeable, water-insoluble pouch or container, adaptable to being fastened onto the central agitating post and having contained therein a laundry active. The laundry active dissolves out of said water-permeable container by force of the agitating post and wash water. By employing such a dispenser, the consumer can be given the improved solubility performance as from free-bodied contained laundry active dispensers, and at the same time obtain the convenience of nonhandling of the laundry active itself, and the ease of disposing the container once it has been used. Moreover, such a dispenser is easy to handle, economical to manufacture at a low cost to the consumer, and safe to use.

Another benefit is that the laundry dispenser can be designed to be easily retrieved after the wash operation. The dispenser can be designed to remain attached to the central agitator post for easy recovery. This feature is valued by many consumers of laundry products.

For the purposes of expediency, the invention can be best explained and described by referring to a preferred embodiment thereof which is the subject matter of the accompanying drawings. It is to be understood that the scope of the invention is not to be limited thereto.

Figure 2:
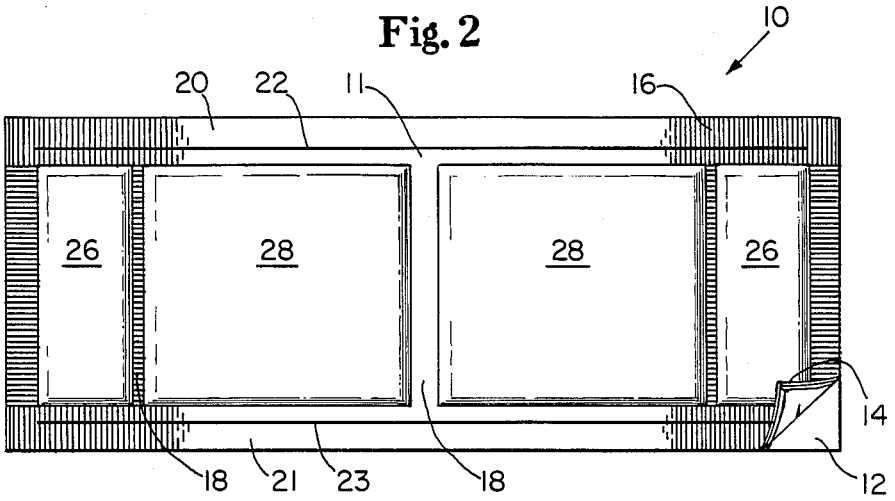
FIG. 2 is a top flat view of the pouched laundry active dispenser of FIG. 1.
Figure 1:
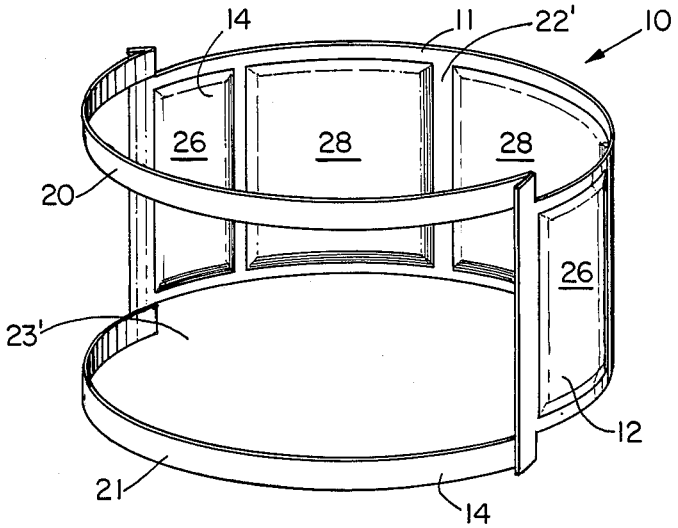
FIG. 1 is a perspective view of a water-permeable, waterinsoluble laundry active dispenser with central agitating post loops and containing pouched laundry actives, which is a preferred embodiment of the present invention.
Figure 3:
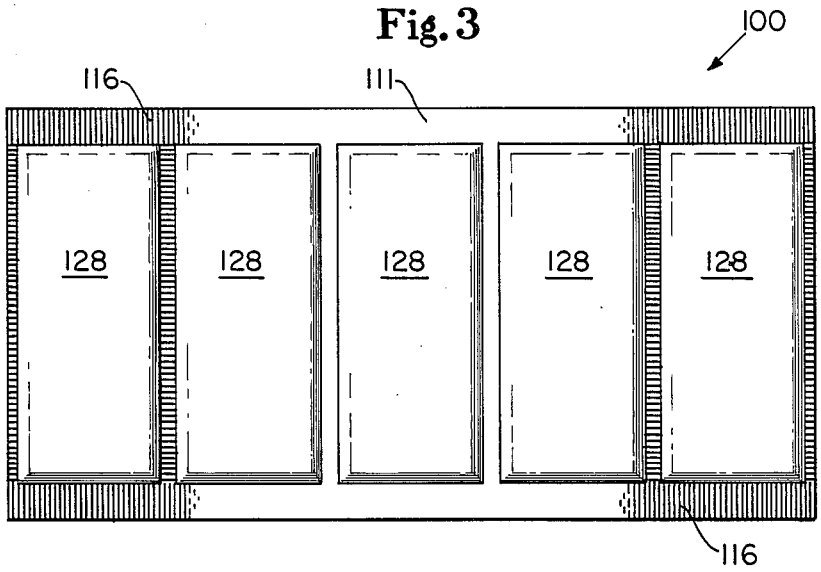
FIG. 3 is a top flat view of an alternative pouched dispenser with different sized pockets.
Figure 4:
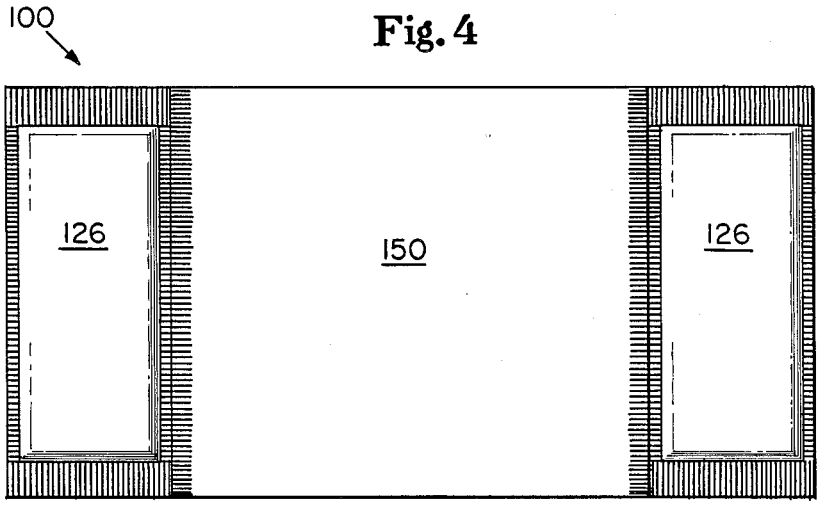
FIG. 4 is a bottom view of the laundry active dispenser of FIG. 3 showing an alternate means of attachment to the central agitating post of an automatic clothes washing machine.
Figure 5:
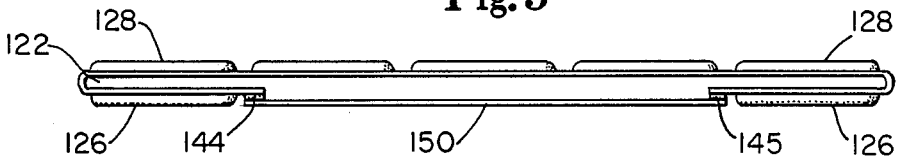
FIGS. 5 and 6 are horizontal cross-sectional view of the laundry active dispenser shown in FIGS. 3 and 4.
Figure 6:
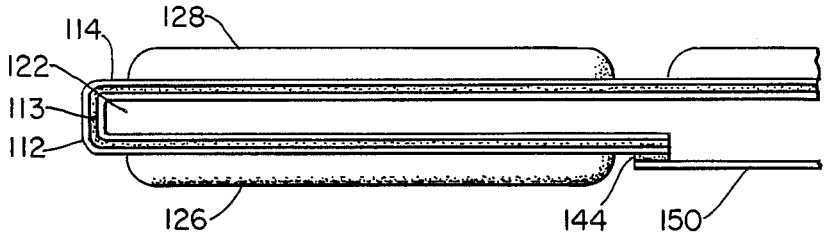

Referring now to FIGS. 1 and 2, a preferred embodiment of a laundry active dispenser 10 is shown having two equal laminated rectangular sheets, 12 and 14. The sheets are made of a flexible laminar water-permeable, water-insoluble material permanently sealed together at their peripheral edges 11, in this particular instance, by means of a continuous heat seal 16. It is not intended , however, to limit the present embodiment to such flexible laminar materials, or to the provision of a heat sealing means. Referring to FIG. 1, the two laminar sheets are also joined together by means of heat seals 16 and 18 to divide the dispenser 10 into four rectangular container pouches 26 and 28.

Referring to FIGS. 1 and 2, the preferred dispenser is made by first embossing one of the substrate sheets, e.g., 14, to form deeper pockets for the pouches to contain the laundry active ingredients. Next, the ingredients are placed in the indentations created by the embossing. A sheet of polyethylene film (not shown) can be precut to match the seal areas 16 and 18 which are around and between the pouch pockets 26 and 28. This sheet is placed in position to line up with the embossed sheet. The second sheet 12 is then put in place and heat is applied to the embossed sheet. The heat melts the polyethylene film and seals the laundry actives inside the pouched pockets. The seals 16 and 18, in conjunction with the laminar sheets 12 and 14, form the sealed container pouches 26 and 28 having the laundry additives (not shown on drawing) disposed therein. See U.S. Pat. No. 4,638,907, Bedenk et al., issued Jan. 27, 1987, incorporated herein by reference, for more details on how embossed, pouched laminated dispensers are made.

Figure 7:
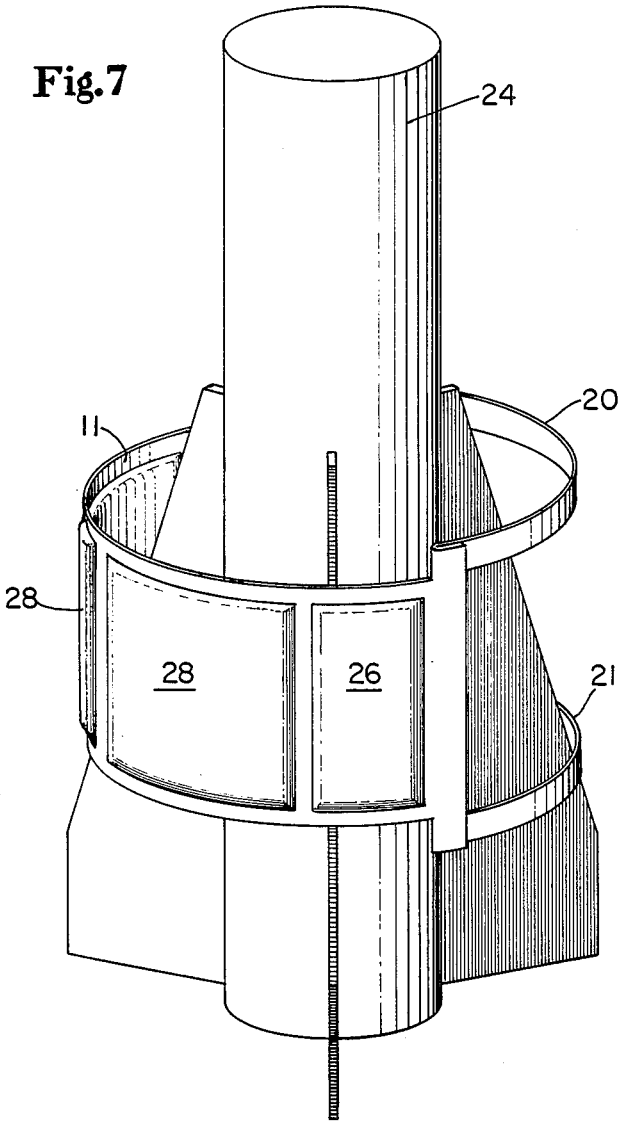
FIG. 7 is a perspective view of the laundry active dispenser of FIG. 1 positioned about a central agitating post of an automatic clothes washing machine.

The top and bottom peripheral edges 20 and 21 have slits 22 and 23 so as when opened, circular loops 22' and 23' are formed which are large enough to be loosely fitted (fastened) about the central agitating post 24 of an automatic clothes washing machine (see FIG. 7). An advantage of having two circular loops 22' and 23' is that the dispenser 10 is held more closely to the agitator. In a modified dispenser 10, the container pouches 26 and 28 can be designed so that the dispenser is perforated (not shown) so it could be torn in half or used in larger or smaller loads. Each half would have a circular loop for fastening to the agitator post.

In order to provide dissolution and egress of the laundry actives (not shown on drawing) from their container pouches 26 and 28 into the automatic clothes washing machine (not shown) during the operation of the wash period, at least one of the two sheets 12 and 14 that forms the container pouches 26 and 28 of the dispenser 10 is water-permeable. It will be noted that the slits 22 and 23 do not extend across the entire length of the sheets' peripheral edges 11. The object to be kept in mind, in accordance with the invention, is to provide a means to fasten the container pouches to the central post 24 to allow the laundry active to dispense from the container pouches in response to the movement of the central agitating post and the pressure of the wash load. Preferably, the seals do not rupture. Accordingly, the nature of materials used for making the dispenser 10 should be so selected.

Accordingly, the operation of the preferred laundry active dispenser is simply begun by looping the dispenser onto the central agitating post 24, preferably before the operation of the machine has been initiated, in the manner shown in FIG. 7. Once the machine is started, it will be seen that the dispenser is activated by the wash period of the automatic washer. After the automatic washer has gone through its complete operation, the used dispenser can be lifted off the central agitating post and discarded or placed in the dryer with the washed fabrics.

OTHER EMBODIMENTS

A reusable dispenser pouch can be used, e.g. a two-sided bag designed like a spring closing "coin purse" made out of a porous, flexible material. Two elongated pieces of semi-ridged spring material (metal or plastic) are affixed to the bag at the opening. One piece on each side parallel to the other such that the opening of the bag is between them. Normally the bag is in the closed condition with its sides touching. However, when force is applied to its ends, the bag opens forming a circular opening so it can be used as a scoop and filled with detergent, etc. A strap can be attached to the opening ends to go around the agitator post.

In view of what has been described as a preferred embodiment, it will be appreciated that other forms and embodiments are also within the scope of the present invention. Several of the critical features that must be inherent in the type of dispenser previously described and employed to dispense the laundry additive are that the laundry active(s) can be coated on or completely enclosed in the dispenser for release in the wash cycle. There must be a potential for water-permeability in the unit to allow dissolution and egress of the laundry active(s) into the wash aided by the agitation force of the central agitating post acting upon the unit and the wash load.

Accordingly, any number of materials other than a flexible laminar nonwoven substance can be used for the container to enclose the laundry active, for example, porous metal foils, porous plastic bags, and the like. The material used, however, must be compatible with the nature of the laundry active which it is to contain, so that the chemical or physical identity of the container itself or the laundry active is not altered.

With the above in mind, other materials can be used, such as porous foil sheeting, paper sheeting, porous plastic boxes, nonwoven or woven cloth sheeting.

With regard to the attachmemt or fastening of the dispenser to the central agitating post of the automatic washer, any number of methods or means that are compatible with the dispenser design and provides for a means to fasten the dispenser to allow exit of the active from the water-permeable, water-insoluble container into the wash water through agitation force can be used. See U.S. Pat. No. 4,026,131, supra, for suitable fastening means designs.

The fastening means of the dispenser can be designed to rupture during the spin cycle so that the dispenser will be automatically mixed with the washed fabrics for dryer use.

Referring to FIGS. 3, 4, 5 and 6, dispenser 100 is another preferred embodiment. Dispenser 100 is shown having two sheets 112 and 114. The sheets may or may not be of the same material. The sheets 112 and 114 are joined together at their ends with a third sheet 150 with glue seals 144 and 145 to form a "loop" shaped loop 122 (FIG. 5) which fits around the central agitating post of the automatic washer. In other words, this dispenser 100 is one continuous strip that can be "looped" around the central agitating post.

In general, any suitable means can be used for fastening the dispenser of the present invention to the central agitating post. For example, magnets, bags, cages, clips, wires, strings, velcro fasteners, hooks and foil are some of the materials or forms that can be used, although the scope of the invention herein is not limited to the same. Thus, the fastening means can be packaged separately from the pouched laundry active. It can be semi- or permanently attached to the agitator, e.g., a cage in which the pouch is inserted.

In addition to the above embodiments, the present invention can be combined with dispenser devices which are activated in the spin period or the rinse period of the washing machine operation or the drying operation. In this respect, reference is made to U.S. Pat. No. 4,026,131, supra, and Hortel et al., supra, both incorporated herein by reference in their entirety.

LAUNDRY ACTIVES

The type and nature of laundry actives that can be used are any number of commercially available actives on the market. By the term "laundry active" is meant any substance that is added to the laundry during the wash period of a standard automatic clothes washing machine having a central agitating post.

While not being limited to the following types of ingredients, the laundry actives include the detergents, peroxyacid bleaches, etc., "optical bleaches" (fluorescent dyes), soil release agents, and other laundry aids. Of particular importance are the bleaches and detergents in granular form.

In addition to the above, the physical nature of the laundry active can be in the form of a coating, paste, gel, powder, granules, flakes, pellets, or any other form that is compatible with the chemical nature of the container and some of which can be dispensed from the container by the action of the wash water, the agitation of the center post and the force of the wash load.

Some preferred laundry actives and laundry additives are disclosed in Hortel et al., supra, and U.S. Pat. No. 4,770,666, to Clauss, Sept. 13, 1988, incorporated herein by reference.

EXAMPLE 1

One example of the present invention is the laundry active dispenser 10 shown in FIGS. 1, 2 and 7. This laundry active dispenser has been constructed so it can be packed flat and when used easily slipped over the top of the washing machine central post agitator, where it remains throughout the wash cycle. Dispenser 10 is 4½ inches (11.4 cm) tall. The circumferences of loops 22' and 23' are about 21 inches (53 cm), which is large enough to easily fit over virtually every washing machine central post agitator. It is also large enough to slip half way or more down on the central post agitator so that when the consumer wants to use the machine to wash a small load, which requires low water fills, the dispenser and its contained laundry additives will be submerged and can dissolve.

This example is constructed of materials that are strong enough to survive the reciprocal agitation and centrifugal spin forces of the washer cycle. It can then be put in the dryer along with the wet laundry to dispense water-insoluble additives, e.g., a through the wash and rinse fabric softening and antistatic agent that has been designed to survive the wash and which is activated by the heat of the dryer. The substrate used in this example is a spunbonded polyester nonwoven supplied by DuPont under the trade name Reemay ®2420. For other suitable detergent and bleach actives, softeners and substrates, see Hortel et al., supra, incorporated herein by reference.

This dispenser 10 also has multiple pouches (pockets). Each one can be used to hold one or more laundry actives, for example, laundry detergent, bleach, enzymes, optical brighteners, builders and other chemicals used to clean or condition laundry in the washer or dryer.

The dispenser 10 was compared to a free-body dispenser of the same general design but without being fastened to the central post agitator. The "free-body" dispenser was free to travel throughout the wash load. The wash actives of the dispenser 10 of this invention dissolved in a few minutes as indicated by measuring the time to reach the maximum electrical conductivity of the wash solution provided by the laundry granules. The free-body dispenser failed altogether to completely dissolve even after a normal 8 minute wash period cycle. The testing was done with a normal 7½ pound bundle of clothes in cold (40° F.) medium hard (8 grains/-gal.) water.

Thus, laundry dispensers of the present invention facilitate the dissolving of their wash period laundry actives, completely, in all typical wash cycles and wash loads at various washer fill levels and temperatures. The present invention demonstrates the benefits of eliminating residual, undissolved wash period actives from pouched laundry dispensers resulting in superior cleaning by virtue of more active ingredients present in the wash water sooner in the wash period cycle.

What is claimed is:

1. A disposable dispenser for dispensing a laundry active into an automatic central post agitator washing machine wash period water, said dispenser comprising:

A. at least one container pouch made with a water-permeable, water-insoluble substrate;

B. a soluble laundry active contained by said pouch; and

C. a fastening means integral with said pouch and forming at least one loop to fasten said pouch to the automatic washing machine central post agitator;

whereby said pouch is restrained to an area near said central post agitator and in said wash period water for controlled release of said laundry active into said wash period water.

2. The dispenser defined in claim 1 wherein said container pouch and fastening means both comprise a flexible material, said flexible material being a nonwoven substrate.

3. The dispenser defined in claim 1 wherein said container pouch is made of at least two sheets of flexible nonwoven material having their perimeters joined and sealed to each other for the containment of said soluble laundry active.

4. The dispenser defined in claim 1 wherein said container pouch comprises a flexible, porous, formed plastic film that is chemically compatible with the laundry active.

5. The dispenser of claim 1 wherein said soluble laundry active is selected from the group consisting of detergents, bleaches, soil release agents, brighteners and fabric aids and at least one of said selected group is contained inside said pouch.

6. The dispenser defined in claim 1 wherein said dispenser is designed to be packaged flat and has two fastening means.

* * * * *

UNITED STATES PATENT AND TRADEMARK OFFICE

CERTIFICATE OF CORRECTION

PATENT NO. : 4,875,575

DATED : October 24, 1989

INVENTOR(S) : Stephen W. Snyder, Craig C. Monsell, Carol S. Puckett and Russell R. Driver It is certified that error appears in the above-identified patent and that said Letters Patent is hereby corrected as shown below:

Title Page: (75) Inventors: after "Puckett" insert -- ;Russell R. Driver --.

Signed and Sealed this

Eighteenth Day of June, 1991

*Attest:*

HARRY F. MANBECK, JR.

*Attesting Officer*

*Commissioner of Patents and Trademarks*